US005678151A

United States Patent [19]

Miyashiro et al.

[11] Patent Number: 5,678,151

[45] Date of Patent: Oct. 14, 1997

[54] TONER ADHESION PREVENTING MECHANISM FOR IMAGE FORMING APPARATUS

[75] Inventors: Toshiaki Miyashiro, Ichikawa; Akihiko Takeuchi, Yokohama; Toshihiko Ochiai, Tokyo; Motoi Kato; Takehiko Suzuki, both of Yokohama, all of Japan

[73] Assignee: Canon Kabushiki Kaisha, Tokyo, Japan

[21] Appl. No.: 728,167

[22] Filed: Oct. 9, 1996

Related U.S. Application Data

[63] Continuation of Ser. No. 238,050, May 4, 1994, abandoned.

[30] Foreign Application Priority Data

May 7, 1993 [JP] Japan ..... 5-130088

[51] Int. Cl.[6] ..... G03G 15/01; G03G 21/00

[52] U.S. Cl. ..... 399/303; 399/350

[58] Field of Search ..... 361/225, 229; 399/303, 313, 343, 350, 351

[56] References Cited

U.S. PATENT DOCUMENTS

| | | | |
|---|---|---|---|
| 4,278,342 | 7/1981 | Andrew et al. | 355/296 X |
| 4,851,960 | 7/1989 | Nakamura et al. | 361/225 |
| 5,115,277 | 5/1992 | Camis | 355/326 R X |
| 5,258,782 | 11/1993 | Ochiai | 355/296 X |
| 5,383,011 | 1/1995 | Numagami et al. | 355/299 X |
| 5,450,185 | 9/1995 | Kuribayashi et al. | 355/299 |

FOREIGN PATENT DOCUMENTS

| | | |
|---|---|---|
| 63-149669 | 2/1988 | Japan . |
| 64-13574 | 1/1989 | Japan . |
| 2-108091 | 4/1990 | Japan . |

*Primary Examiner*—S. Lee

*Attorney, Agent, or Firm*—Fitzpatrick, Cella, Harper & Scinto

[57] ABSTRACT

An image forming apparatus includes an image bearing member, an image forming means for forming a toner image on the image bearing member, a rotary member contacted with a surface of the image bearing member, a transfer member for transferring the toner image from the image bearing member to the rotary member, and a cleaning member for removing residual toner from the image bearing member. Wherein a longitudinal width of a contact area between the image bearing member and the rotary member is smaller than the length of the cleaning member.

18 Claims, 8 Drawing Sheets

TONER ADHESION PREVENTING MECHANISM FOR IMAGE FORMING APPARATUS

This application is a continuation of application Ser. No. 08/238,050 filed May 4, 1994, now abandoned.

BACKGROUND OF THE INVENTION

1. Field of the Invention

The present invention relates to an image forming apparatus such as a copying machine, a printer and the like, and more particularly, it relates to an image forming apparatus of a type wherein a toner image formed on an image bearing member is transferred onto a rotary member contacted with the image bearing member.

2. Related Background Art

An example of an image forming apparatus of a type wherein a toner image formed on an image bearing member is transferred onto a rotary member contacted with the image bearing member is shown in FIG. 7. This apparatus is a full-color printer in which color toner images formed on an image bearing member 51 are successively transferred onto a recording material supported on a rotary member 55 to obtain a full-color image. That is to say, light from an optical unit 52 is illuminated onto the image bearing member (photosensitive member) 51 uniformly charged by a charge means 50, thereby forming a latent image corresponding to one color component of the image on the image bearing member. At the same time, a recording material P is fed from a cassette 53 by means of a supply means 54 and is wound around a transfer drum (rotary member) 55, and the transfer drum is rotated. Further, the latent image formed on the image bearing member 51 is developed by a developing means with having a color corresponding to the above-mentioned color component as a developer image, and then, the developer image is transferred onto the recording material P supported on the transfer drum. By repeating such operations regarding various color components of the image, a multi-color image is transferred to the recording material. The multi-color image is fixed to the recording material by a fixing means 57.

On the other hand, after the transferring operation, the residual developer remaining on the image bearing member 51 is removed by a cleaning blade **58*a* of a cleaning means 58, and the developer adhered to the transfer drum 55 is scraped and removed by a fur brush 59*a* of a cleaning means 59**.

The developer adhered to the transfer drum 55 includes developer scattered within the printer and excessive developer that migrated from the image bearing member 51. Among these developers, the amount of the developer migrated from the image bearing member 51 is the greatest. The excessive developer adhered to the image bearing member 51 includes fog developer adhered to the image bearing member 51 during the developing operation and/or developer leaking from longitudinal ends of the blade **58*a* of the cleaning means 58** during the cleaning operation.

Particularly, the developer leaking from ends of the blade **58*a* has the tendency to increase as the number of copies is increased, and the amount of such developer is greater than that of the fog developer. In general, seal members made of sponge or the like are attached to the ends of the cleaning blade to prevent leakage of developer (toner). However, in the conventional techniques, it is difficult to completely prevent the leakage of toner having minute average particle diameter of the order of several μm. Further, the toner leaking from the ends of the blade and migrating onto the transfer drum is squeezed by the image bearing member to be shifted toward zones (on the surface of the transfer drum) out of the recording material bearing area and to be fused on such zones (which zones are shown as black bands t on the transfer drum 55 in FIG. 8), with the result that such fused toner cannot be removed by the cleaning means 59**.

Further, the toner leaking from the ends of the blade is also fused on zones on the surface of the image bearing member out of the toner image bearing area (which zones are shown as black bands t on the image bearing member 51 in FIG. 8). In addition, the toner fused to the transfer drum and the image bearing member gradually swells as the toner newly leaking from the ends of the blade is also adhered to the fused toner. Due to the presence of such fused toner, the rotation accuracy of the image bearing member and the transfer drum which are contacted with each other decreased. Further, since an undesirable gap is created between the image bearing member and the transfer drum, the transferring efficiency of the toner image from the image bearing member to the transfer drum is worsened, with the result that the desired image cannot be obtained.

SUMMARY OF THE INVENTION

The present invention has as an object to eliminate the above-mentioned conventional drawbacks, and has as an object to provide an image forming apparatus wherein an undesirable gap is not created between an image bearing member and a rotary member which is rotated while contacting with the image bearing member.

Another object of the present invention is to provide an image forming apparatus wherein toner leaking from ends of a cleaning member for cleaning a surface of an image bearing member is not adhered to a contact area between the image bearing member and a rotary member.

A further object of the present invention is to provide an image forming apparatus wherein a longitudinal width of a contact area between an image bearing member and a rotary member is smaller than a longitudinal width of a cleaning member.

The other objects of the present invention will be apparent from the following detailed explanation of the invention referring to the accompanying drawings.

DETAILED DESCRIPTION OF THE PREFERRED EMBODIMENTS

Now, an image forming apparatus (laser beam printer) according to a first embodiment of the present invention will be fully explained with reference to the accompanying drawings.

Figure 1:
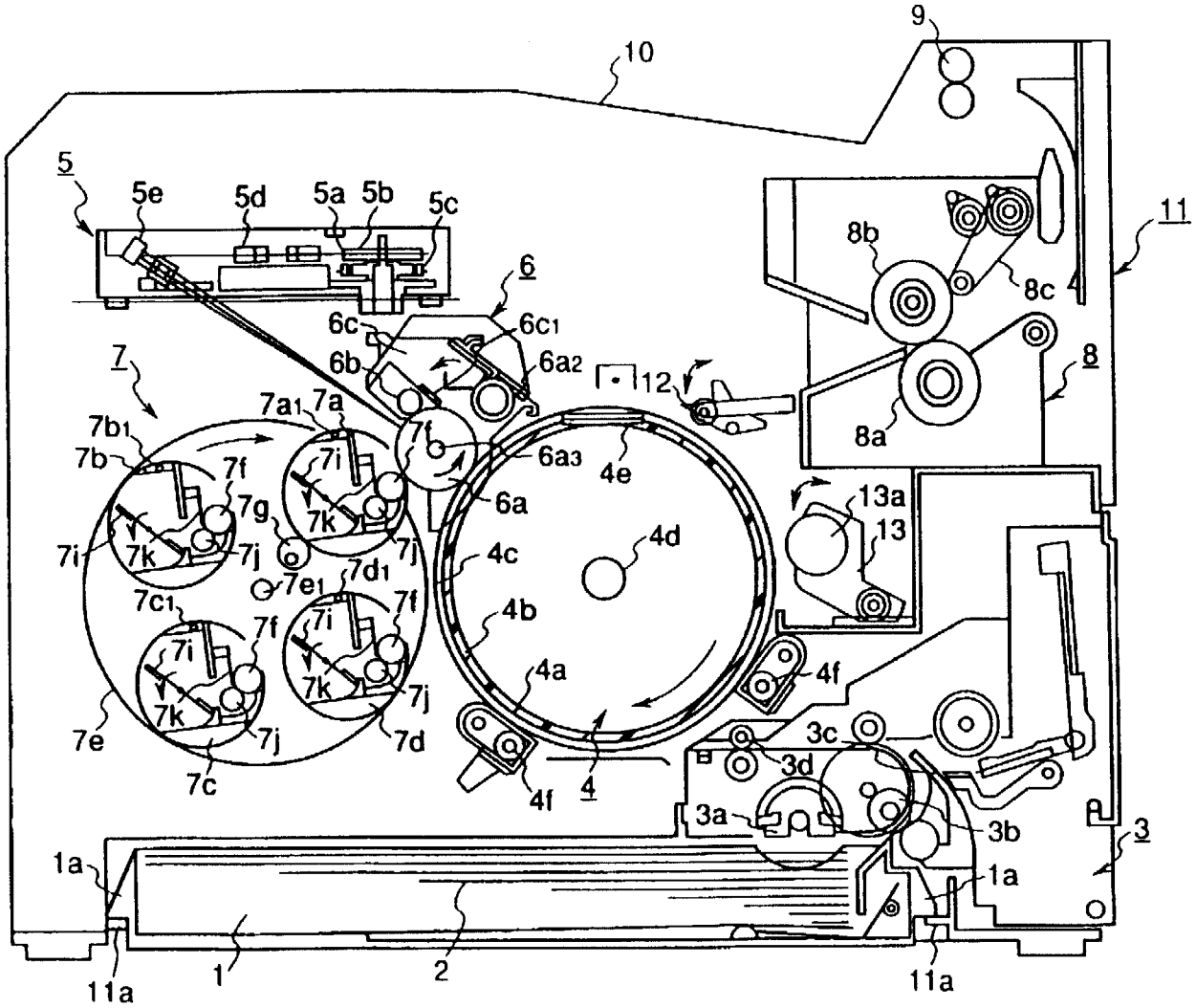
FIG. 1 is a sectional view of an image forming apparatus to which the present invention is applied.

First of all, explaining the entire construction of the image forming apparatus, as shown in FIG. 1, in the image forming apparatus, a recording material 2 is fed from a cassette (stacking means) 1 by means of a supply means 3 and then is wound around a peripheral surface of a transfer drum 4 which is contacted with and rotated together with an image bearing member. Light emitted from an optical unit 5 is illuminated onto the image bearing member unit 6 in response to color image information, thereby forming a latent image on the image bearing member (photosensitive member). The latent image is developed by a developing means 7 comprising four rotatable developing devices as a developer (toner) image. The developer images formed in this way are successively transferred onto the recording material 2 supported on the transfer drum 4 in a superposed fashion, thereby obtaining a full-color image. Then, the recording material 2 to which the full-color toner image was transferred is sent to a fixing means 8, where the toner image is fixed to the recording material 2. Thereafter, the recording material is discharged onto a discharge portion 10 arranged on the apparatus by means of a pair of discharge rollers 9.

Incidentally, the image bearing member unit 6 and the developing devices of the developing means 7 are removable with respect to a body 11 of the image forming apparatus.

Next, various elements of the image forming apparatus will be fully explained in order of operation.

The stacking means serves to store the recording materials 2 therein and is so designed as to be removably mounted to the apparatus. In the illustrated embodiment, there is provided a mounting means for mounting the cassette 1 within the apparatus at its lower portion. That is to say, as shown in FIG. 1, a recess for mounting the cassette 1 therein is formed in the bottom of the body 11 of the apparatus, and guide rails 11*a* are formed on both opposed walls of the recess, the guide rails extending a direction perpendicular to the plane of FIG. 1. On the other hand, engagement projections 1*a* which can be slid on the guide rails 11*a* are formed on both side walls of the cassette 1.

With this arrangement, the cassette 1 can be inserted into and retracted from the body of the apparatus along the guide rails 11*a* by pushing and pulling the cassette 1 via a gripping recessed portion (not shown) formed on the cassette from a front side. By mounting the cassette 1 to the apparatus, the recording materials 2 are set in the apparatus.

Incidentally, the stacking means for the recording materials 2 may comprise the cassette 1 removably mounted to the apparatus as mentioned above, or may comprise a recording material stacking plate slidably drawable with respect to the body 11 of the apparatus without being detached from the body, and the recording materials 2 are stacked on the stacking plate.

The supply means 3 serves to supply the recording material 2 from the cassette 1 to an image forming portion and comprises supply rollers 3*a*, 3*b* which are rotated in response to an image forming operation to separate the recording materials 2 on the cassette 1 mounted to the lower portion of the apparatus body 11 one by one from the uppermost recording material. The separated recording material is guided by a guide plate 3*c* to abut against a nip between a pair of register rollers 3*d*. The pair of register rollers 3*d* are rotated in synchronous with the image forming operation to send the recording material 2 to the transfer drum 4.

The transfer means serves to transfer the developer image developed by the developing means 7 from the image bearing member to the transfer drum 4. In the illustrated embodiment, the toner image is transferred onto the recording material supported on the transfer drum 4 acting as a recording material bearing member.

The transfer drum 4 according to the illustrated embodiment comprises a base (metal core) 4*a* formed from a metallic cylinder and the like, an elastic layer 4*b* formed around the base core 4*a* and made of sponge, rubber or the like, and a dielectric layer 4*c* formed around the elastic layer. The transfer drum 4 is rotatably supported on a shaft 4*d* and is rotated in a direction shown by the arrow at substantially the same speed as the image bearing member in response to the image forming operation by transmitting a driving force of a drive motor to a gear (not shown) secured to the transfer drum 4.

Further, a gripper 4*e* is formed on the transfer drum 4 at a predetermined position, which serves to grip a tip end of the supplied recording material 2. Further, an electrostatic absorb roller 4*f* is arranged to be urged against and separated from the outer peripheral surface of the transfer drum 4. By pinching the recording material 2 between the electrostatic absorb roller 4*f* and the transfer drum 4, the recording material 2 is urged against the outer peripheral surface of the transfer drum 4. By applying a voltage between the electrostatic absorb roller 4*f* and the transfer drum 4, charges are created on the dielectric recording material 2 and the dielectric layer 4*c* of the transfer drum 4, thereby electrostatically absorbing the recording material 2 to the outer peripheral surface of the transfer drum 4.

Incidentally, a method for absorbing the recording material 2 to the transfer drum 4 is not limited to the above-mentioned electrostatic absorption, but, the recording material may be absorbed to the transfer drum by air suction.

In FIG. 1, a separation pawl 12 serves to separate the recording material 2 from the transfer drum 4 after the recording material is released from the gripper 4*e*. A cleaning device 13 is contacted with the surface of the transfer drum 4 and serves to clean the drum surface. The separation pawl 12 and the cleaning device 13 can be rocked in directions shown by the arrows in FIG. 1. Incidentally, the cleaning device 13 according to the illustrated embodiment is comprised of a brush cleaning type having a fur brush 13*a*.

The optical unit 5 serves to emit the light modulated in response to an image signal in order to form the electrostatic latent image on the image bearing member. In the arrangement of the optical unit, as shown in FIG. 1, when the image signal is sent to a laser diode 5*a*, the laser diode 5*a* emits laser light corresponding to the image signal toward a polygon mirror 5b. The polygon mirror 5b is rotated at a high speed by a scanner motor 5c, and the laser light reflected by the polygon mirror 5b is focused on the image bearing member through a focusing lens 5d and a reflection mirror 5e, thereby exposing the image bearing member.

Figure 2:
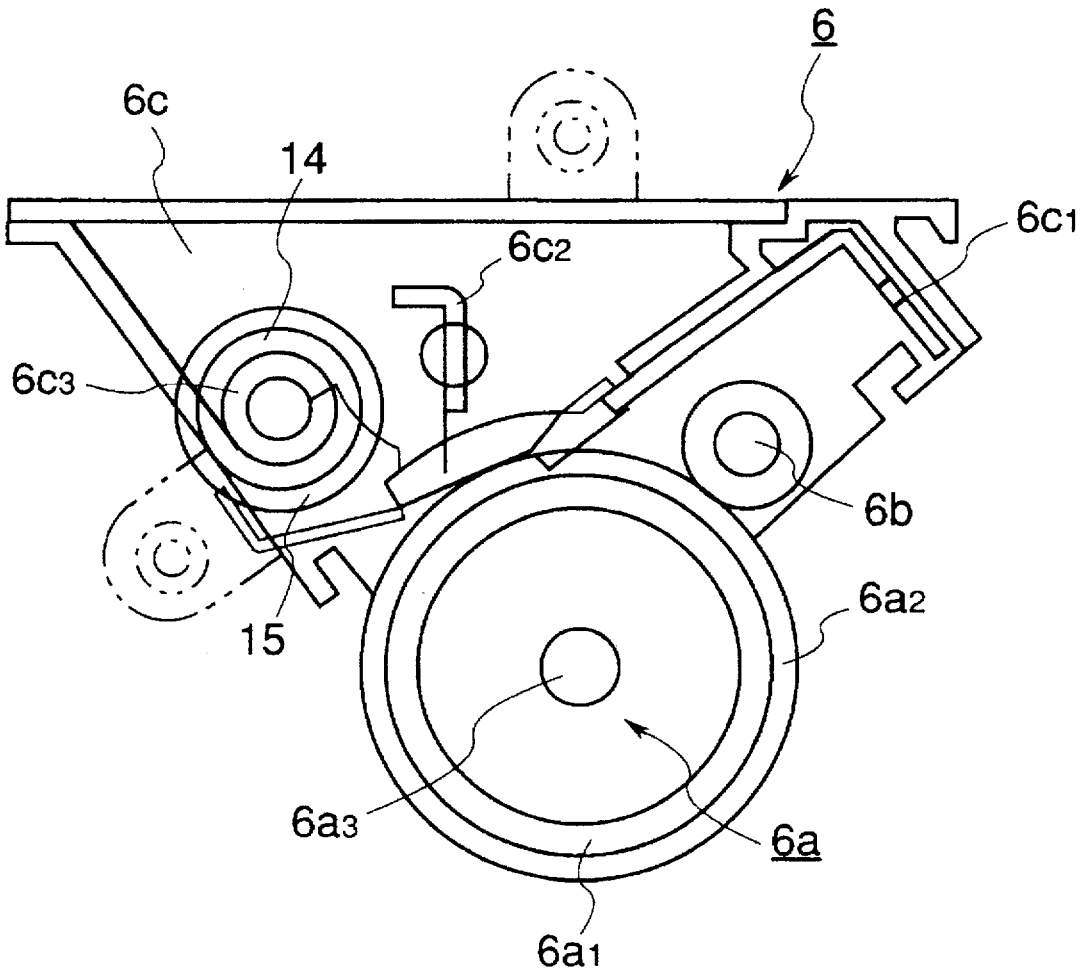
FIG. 2 is a schematic sectional view of an image bearing member unit.

The image bearing member unit 6 comprises a process cartridge integrally incorporating therein the image bearing member and process means acting on the image bearing member. As shown in FIG. 2, the process cartridge includes an image bearing member (photosensitive drum) 6a, and charge means 6b and a cleaning means 6c which are process means acting on the image bearing member 6a.

The image bearing member 6a according to the illustrated embodiment comprises a conductive base 6a1 formed from an aluminium cylinder, and a photoconductive layer 6a2 made of OPC, A-Si, CdS, Se or the like coated on an outer surface of the conductive base 6a, and is rotatably supported by a frame of the image bearing member unit via a shaft 6a3. By transmitting a driving force of a drive motor (not shown) to the shaft 6a3, the image bearing member 6a is rotated in a direction shown by the arrow in response to the image forming operation. Further, the charge means 6b and the cleaning means 6c are arranged around the image bearing member 6a, and the image bearing member unit 6 is removably mounted to the body 11 of the apparatus. That is to say, the unit can be replaced by a new image bearing member unit when the service life of the image bearing member 6a, charge me
6b or cleaning means 6c is expired.

The charge means 6b according to the illustrated embodiment is of a so-called contact charging type as disclosed in the Japanese Patent Laid-open No. 63-149669, wherein a conductive roller is contacted with the image bearing member 6a and, by applying a voltage to the conductive roller, the surface of the image bearing member 6a is uniformly charged. The cleaning means 6c serves to remove the residual toner remaining on the image bearing member 6a after the developer image formed on the image bearing member 6a by the developing means 7 is transferred to the recording material 2. The cleaning means 6c comprises an elastic blade made of urethane rubber or the like and is so designed that the toner on the image bearing member 6a is scraped by a cleaning blade 6c1 and the scraped toner is sent to a waste toner container (not shown) by a waste toner feed vane 6c2 and a waste toner convey screw $6c_3$. When the waste toner container is fully filled with the waste toner, the container is replaced by a new empty waste toner container.

The developing means 7 serves to visualize the latent image formed on the image bearing member 6a. In the illustrated embodiment, the developing means includes four developing devices 7a, 7b, 7c, 7d for permitting development with yellow color, magenta color, cyan color and black color, respectively.

Figure 3:
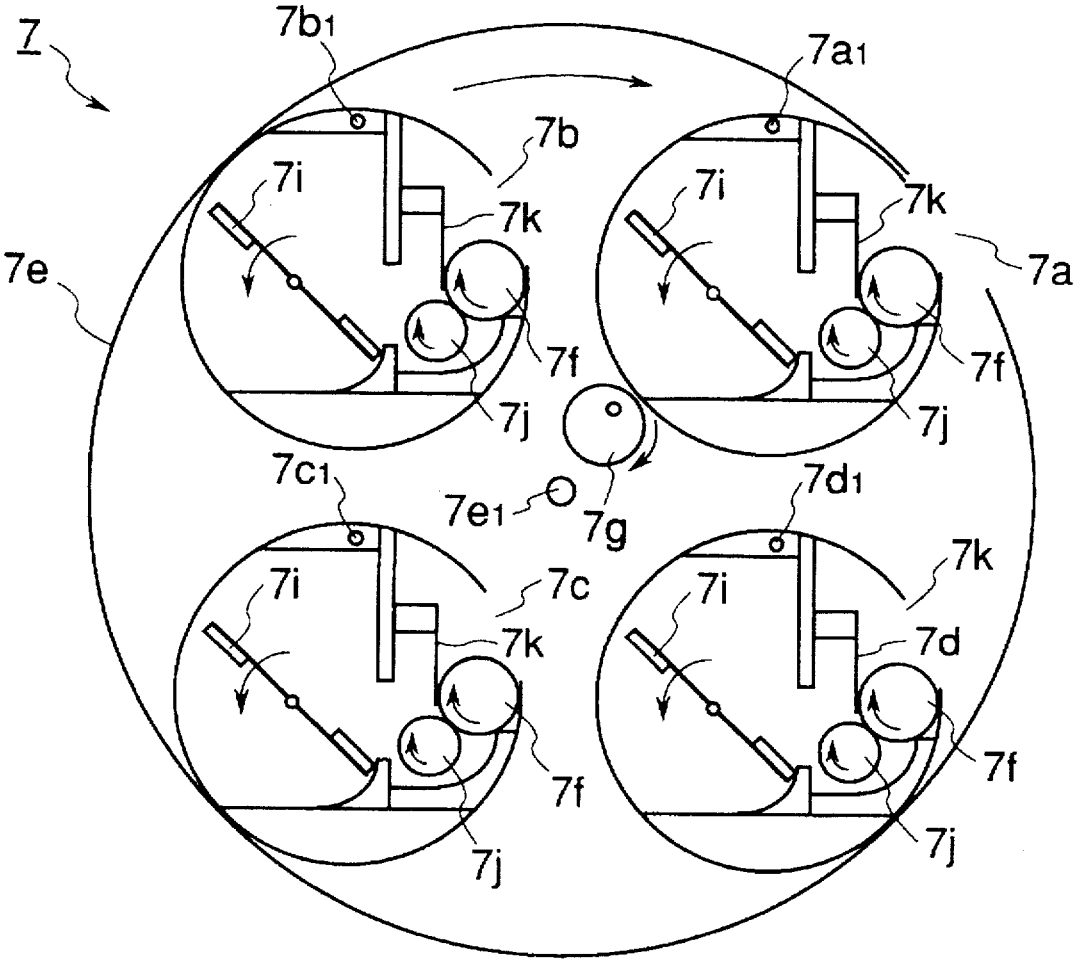
FIG. 3 is a schematic sectional view of a developing means.

As shown in FIG. 3, the developing devices 7a–7d are removably mounted to a developing unit 7e for rotational movements around shafts 7a1–7d1, respectively, and the developing unit 7e is mounted to the body 11 of the apparatus for rotational movement around a shaft 7e1. Further, an eccentric cam 7g for urging the selected developing device against the image bearing member 6a is arranged on the developing unit 7e. Accordingly, even when the developing unit 7e is rotated by its own weight, the postures of the developing devices 7a–7d are always maintained at predetermined orientation. In a developing position, the selected developing device is urged toward the image bearing member 6a with a predetermined force (1 kg weight in the illustrated embodiment) by means of the eccentric cam 7g. In this case, an abutment member (not shown) formed on an end of a developing sleeve 7f of the selected developing device is abutted against a non-image forming area of the image bearing member so that the developing sleeve is opposed to the image bearing member 6a with a small gap (about 150–450 μm) therebetween.

In the image forming operation, the developing devices 7a–7d including yellow toner, magenta toner, cyan toner and black toner are rotated around the shaft 7e1, and the developing sleeve 7f of the selected developing device is urged toward the image bearing member 6a by means of the eccentric cam 7g so that the small gap (about 150–450 μm) is created between the developing sleeve and the image bearing member 6a. Then, the latent image on the image bearing member 6a is developed with the color toner included in the selected developing device. In this way, various color toner images are successively formed on the image bearing member. That is to say, in the developing device containing the toner corresponding to the color to be developed, the toner is sent to a coating roller 7j by a toner feed mechanism 7i, a toner layer is formed on a peripheral surface of the rotating developing sleeve 7f by means of the rotating coating roller 7j and a developing blade 7k, and the charge is applied to the toner due to the friction charge phenomenon. By applying developing bias between the developing sleeve 7f and the image bearing member 6a on which the latent image was formed, the toner image corresponding to the latent image is formed on the image bearing member 6a.

Further, when the selected developing device 7a, 7b, 7c or 7d is rotated to the developing position, the developing sleeve 7f of the selected developing device is electrically connected to a high voltage developing source so that selective application of voltage can be effected regarding the respective development with a different colors. Further, when negative charge is applied to the toner, the developing blade 7k may be made of nylon or the like; whereas, when positive charge is applied to the toner, the developing blade 7k may be made of silicone rubber or the like. That is to say, the developing blade may be made of material which can be charged with charge polarity opposite to that of the toner. Further, it is preferable that a peripheral speed of the developing sleeve 7f is greater than that of the image bearing member 6a by 1.0–2.0 times.

The fixing means 8 serves to fix the toner image to the recording material 2. As shown in FIG. 1, the fixing means comprises a drive roller 8a, and a fixing roller 8b urged against the drive roller and adapted to apply heat and pressure to the recording material 2. The recording material 2 separated from the transfer drum 4 is sent to the fixing means 8, where the recording material is moved by the drive roller 8a, and the heat and pressure are applied to the recording material by the fixing roller 8b, thereby fixing the toner image to the recording material 2. Incidentally, a cleaning device 8c is contacted with the fixing roler 8b so that the toner adhered to the fixing roller 8b is removed by the cleaning device 8c.

Next, a positional relation between the above-mentioned elements will be explained with reference to FIG. 4. More specifically, a positional relation between the recording material 2, image bearing member 6a, cleaning means 6c, transfer drum 4 and cleaning means 13 will be explained.

Figure 4:
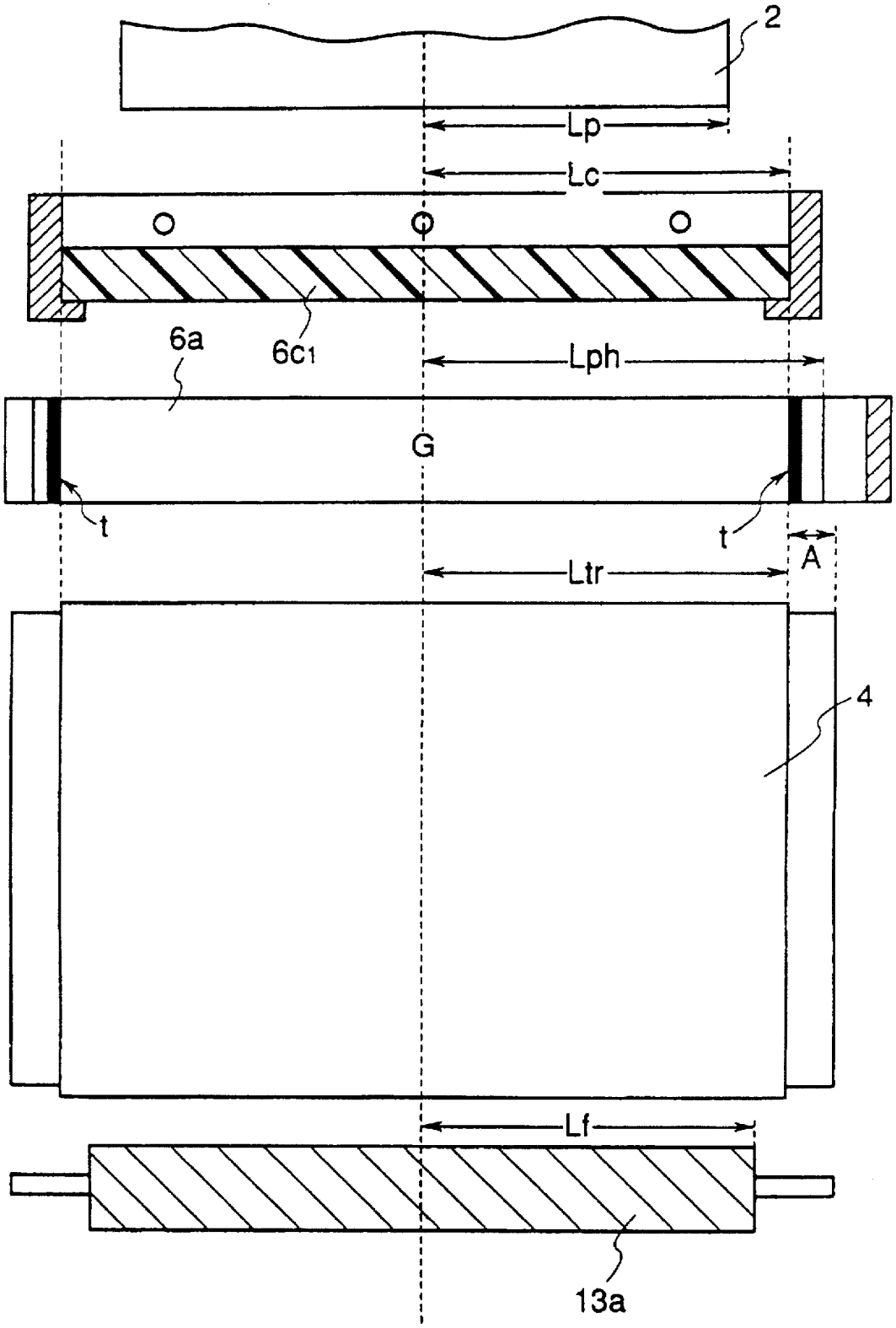
FIG. 4 is a schematic view showing a longitudinal dimensional relation between a photosensitive layer of a photosensitive drum **6*a*, a cleaning blade $6c_1$, a recording material holding portion of a transfer drum 4, a recording material 2 and a transfer drum cleaning member 13*a***, according to a first embodiment of the present invention.

In FIG. 4, a symbol G denotes a straight line extending to the same direction as a recording material conveying direction, i.e. a straight line transverse to a center of a longitudinal direction of the image bearing member 6a.

According to the present invention, in order to prevent the developer (toner) leaking from longitudinal ends of the cleaning blade 6c1 from adhering to ends of the image bearing member 6a and ends of the transfer drum 4 to fuse such ends due to the sliding friction between these elements 6a, 4, the ends of the image bearing member 6a and the ends of the transfer drum 4 to which the developer is apt to fuse are separated from each other. That is to say, a longitudinal width of a contact area between the image bearing member and the transfer drum is smaller than a longitudinal width of the cleaning blade.

More specifically, as shown in FIG. 4, when a distance between the straight line (reference line) G and the end of the cleaning blade 6c1 is Lc, a distance between the reference line G and the end of the photosensitive layer (photo-conductive member 6a1) of the image bearing member 6a is Lph and a distance between the reference line G and the end of the transfer drum contacted with the photosensitive layer of the image bearing member 6a (i.e. a distance between the reference line G and the end of the recording material holding portion of the transfer drum 4) is Ltr, the following relation is established:

$$Lph \geqq Lc \geqq Ltr \quad (1)$$

Accordingly, even if the developer leaking from the ends of the cleaning blade 6c1 is adhered to the ends of the image bearing member 6a to create developer bands t on the ends of the image bearing member 6a, the developer bands t are not frictionally slid between the image bearing member 6a and the transfer drum 4. Accordingly, since the toner (developer) is not adhered to the contact area between the transfer drum and the image bearing member, an undesirable gap is not created between the image bearing member and the transfer drum.

The present invention is particularly effective in a case where the above-mentioned transfer drum, i.e. a cylindrical transfer drum wherein the metal core on which the dielectric layer is coated along the entire peripheral surface thereof extends along substantially the entire length (longitudinal direction) of the transfer drum is used. The reason is that, in comparison with a transfer drum having an arrangement in which a dielectric sheet is wound around a pair of parallel rings, since the urging pressure between the transfer drum and the image bearing member becomes greater, the toner can easily be fused, to the ends of the transfer drum.

Further, when a distance between the reference line G and the end of the fur brush 13a of the cleaning device 13 is Lf, and a distance between the reference line G and the end of a recording material 2 of maximum size is Lp, it is more preferable that the following relation is satisfied:

$$Lph \geqq Lc \geqq Ltr \geqq Lf \geqq Lp \quad (2)$$

Incidentally, so long as the above-mentioned relations (1) and (2) are satisfied, when the entire length of the cleaning blade 6c1 is Lc', the entire length of the photosensitive layer (photo-conductive layer 6a1) of the image bearing member 6a is Lph', a length of the contact area between the transfer drum and the image bearing member 6 or the entire length of the recording material holding portion on the transfer drum 4 is Ltr', the entire length of the fur brush 13a of the cleaning device 13 is Lf', and the entire width of a recording material 2 of maximum size is Lp', the following relations are established:

$$Lph' \geqq Lc' \geqq Ltr', \text{ and}$$

$$Lph' \geqq Lc' \geqq Ltr' \geqq Lf' \geqq Lp'$$

Further, as the above relation (2), when Ltr ≧Lf is established, the ends of the fur brush 13a of the cleaning device 13 extend out of the recording material holding portion of the transfer drum 4, with the result that the furs on the ends of the fur brush contacted with stepped portions (areas A in FIG. 4) can be prevented from falling out.

Thus, more preferably, although a relation Ltr>Lf should be established in consideration of the fundamental object of the fur brush 13a (to prevent the back surface of the recording material 2 held by the transfer drum 4 from smudging), it is preferable that the distance Lf between the reference line G and the end of the fur brush is selected to have a relation Lf≧Lp with respect to the distance between the reference line G and the end of the recording material 2 of maximum size.

Incidentally, an example of the entire length Lc' of the cleaning blade 6c1, the entire length Lph' of the photosensitive layer (photo-conductive layer 6a1) of the image bearing member 6a, the entire length Ltr' of the recording material holding portion on the transfer drum 4, the entire length Lf' of the fur brush 13a of the cleaning device 13, and the entire width Lp' of the recording material 2 of maximum size are as follows:

| | |
|---|---|
| (1) Entire length (Lph') of photosensitive layer | about 266.0 mm; |
| (2) Entire length (Lc') of cleaning blade | about 228.5 mm; |
| (3) Entire length (Ltr') of recording material holding portion | about 220.0 mm; |
| (4) Entire length (Lf') of fur brush | about 215.0 mm; |
| (5) Entire width (Lp') of recording material | about 210.0 mm. |

However, the present invention is not limited to this example, but such lengths and width can be appropriately selected.

Next, the image forming operation effected by the above-mentioned image forming apparatus will be explained. The recording material 2 is separated from the other recording materials in the cassette 1 by rotating the supply rollers 3a, 3b, and the separated material is sent to the transfer drum 4. The transfer drum 4 is rotated in the direction shown by the arrow, and the tip end of the supplied recording material 2 is gripped by the gripper 4d so that the recording material 2 is electrostatically absorbed around the drum.

The image bearing member 6a is rotated in the direction shown by the arrow in FIG. 1 in a synchronous fashion with the rotation of the transfer drum 4. The surface of the image bearing member 6a is uniformly charged by the charge means 6b, and the light corresponding to the yellow color component emitted from the optical unit 5 is illuminated onto the image bearing member, thereby forming the yellow latent image on the image bearing member 6a. At the same time as the latent image formation, the developing device containing the yellow toner is driven to be brought to the image bearing member 6a, with the result that the yellow toner is adhered to the latent image formed on the image bearing member 6a by applying the voltage having the same charging polarity and potential as that of the image bearing member to the toner, thereby developing the latent image with the yellow toner to form a yellow toner image.

Further, by applying the voltage having the polarity opposite to that of the toner to the transfer drum 4, the yellow toner image formed on the image bearing member 6a is transferred onto the recording material 2 supported on the transfer drum 4. After the transferring operation, the residual toner remaining on the image bearing member 6a is removed by the cleaning blade 6c1, and the removed toner is sent to the waste toner container by the toner convey screw 6c2.

After the yellow toner image is transferred in this way, the developing device containing the next color toner is rotated to the image bearing member 6a. In this way, similar to the formation and transferring of the yellow color toner image, a magenta color toner image, a cyan color toner image and black color toner image are successively formed and transferred onto the same recording material 2, thereby forming a full-color image on the recording material 2. After the image formation, the recording material 2 is separated from the transfer drum 4 by the separation pawl 12, and the separated recording material is sent to the fixing means 8, where the full-color toner image is fixed to the recording material. After the fixing operation, the recording material is discharged onto the discharge portion 10 by means of the pair of discharge rollers 9. In this way, the image forming operation is completed.

Next, a second embodiment of the present invention will be explained with reference to the accompanying drawings. Incidentally, the same elements as those in the first embodiment are designated by the same reference numerals and explanation thereof will be omitted.

Figure 5:
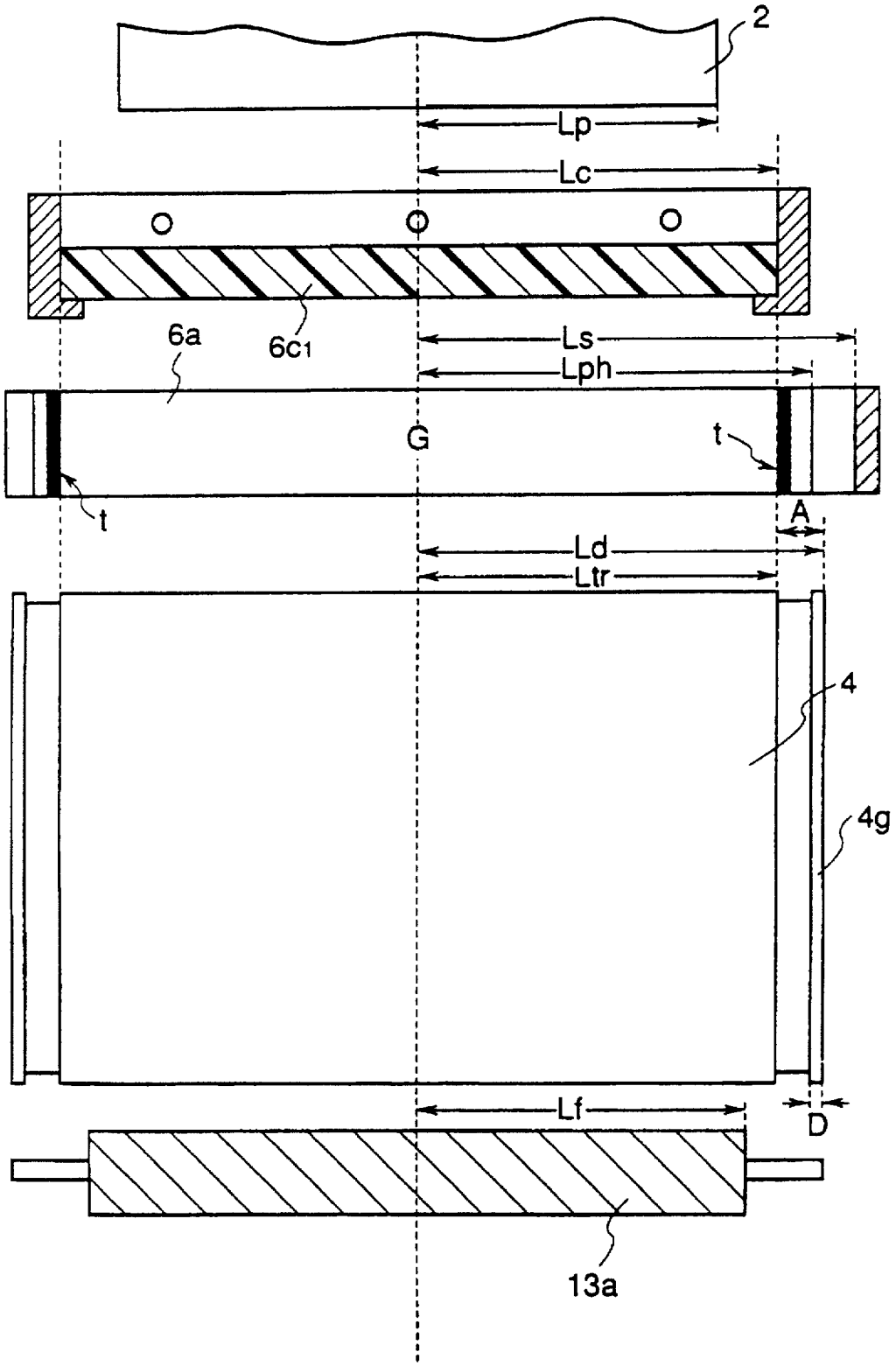
FIG. 5 is a schematic view showing a second embodiment of the present invention and further showing an arrangement of a distance regulating member **4*g* for regulating a distance between a transfer drum 4 and a photosensitive drum 6*a*, as well as the longitudinal dimensional relation of FIG. 4**.

In this second embodiment, the construction of a transfer drum 4 differs from that of the first embodiment. That is to say, as shown in FIG. 5, the transfer drum 4 is provided at both ends with distance regulating members 4g for regulating a distance between the transfer drum 4 and the image bearing member 6a. A peripheral length of a circumferential surface of each distance regulating member 4g contacted with the image bearing member 6a is selected to be substantially the same as the peripheral length of the recording material holding portion of the transfer drum 4. Incidentally, a distance between the reference line G and an inner surface of each distance regulating member 4g is Ld, and a width of the distance regulating member 4g is D. That is to say, when a distance between the reference line G and the inner surface of each distance regulating member 4g is Ld, a width of the distance regulating member 4g is D, and a distance between the reference line G and an end of a support for the image bearing member 6a (end of the conductive base 6a1) is Ls, the following relations are satisfied:

$$Ls>Ld+D>Ld>Lph\geqq Lc\geqq Ltr \quad (3)$$

$$Ld-Lc=A \quad (4)$$

In the above relation (4), A is a length of the stepped portion of the transfer drum 4 for preventing the toner adhered to the end of the image bearing member 6a from transferring to the transfer drum. In this embodiment, the length A of the stepped portion is selected to abut 2–30 mm, and more preferably, about 5–25 mm. With this arrangement, a good image can be obtained. Further, in this embodiment, the width D of the distance regulating member 4g is selected to 2–10 mm, and more preferably, abut 5–8 mm. With this arrangement, the distance regulating members 4g can be used most efficiently.

In the first embodiment, a nip between the image bearing member 6a and the transfer drum 4 is unstable since the nip is determined only by the elasticity of the elastic layer 4b (FIG. 1). However in the second embodiment, by using the distance regulating members 4g as mentioned above, since the nip can be regulated to more desirable nip pressure by the distance regulating members 4g, it is possible to prevent the void in the image which would occur due to the minute change in the nip pressure between the transfer drum 4 and the image bearing member 6a.

Further, since the distance regulating members 4g of the transfer drum 4 are arranged at positions different from the zones on the image bearing member 6a where the toner bands t are formed, the toner is not adhered to the distance regulating members 4g.

Further, by using the dimensional relation as shown in the above relation (3), it is possible to prevent the mechanical deterioration of the photosensitive layer (photo-conductive layer 6a2) of the image bearing member 6a since the distance regulating members 4g do not contact with such a layer, thereby preventing cracking of the photosensitive layer which would occur when a local force is applied to the photosensitive layer.

Next, a third embodiment of the present invention will be explained with reference to the accompanying drawings. Incidentally, the same elements as those in the above-mentioned first embodiment are designated by the same reference numerals and explanation thereof will be omitted.

Figure 6:
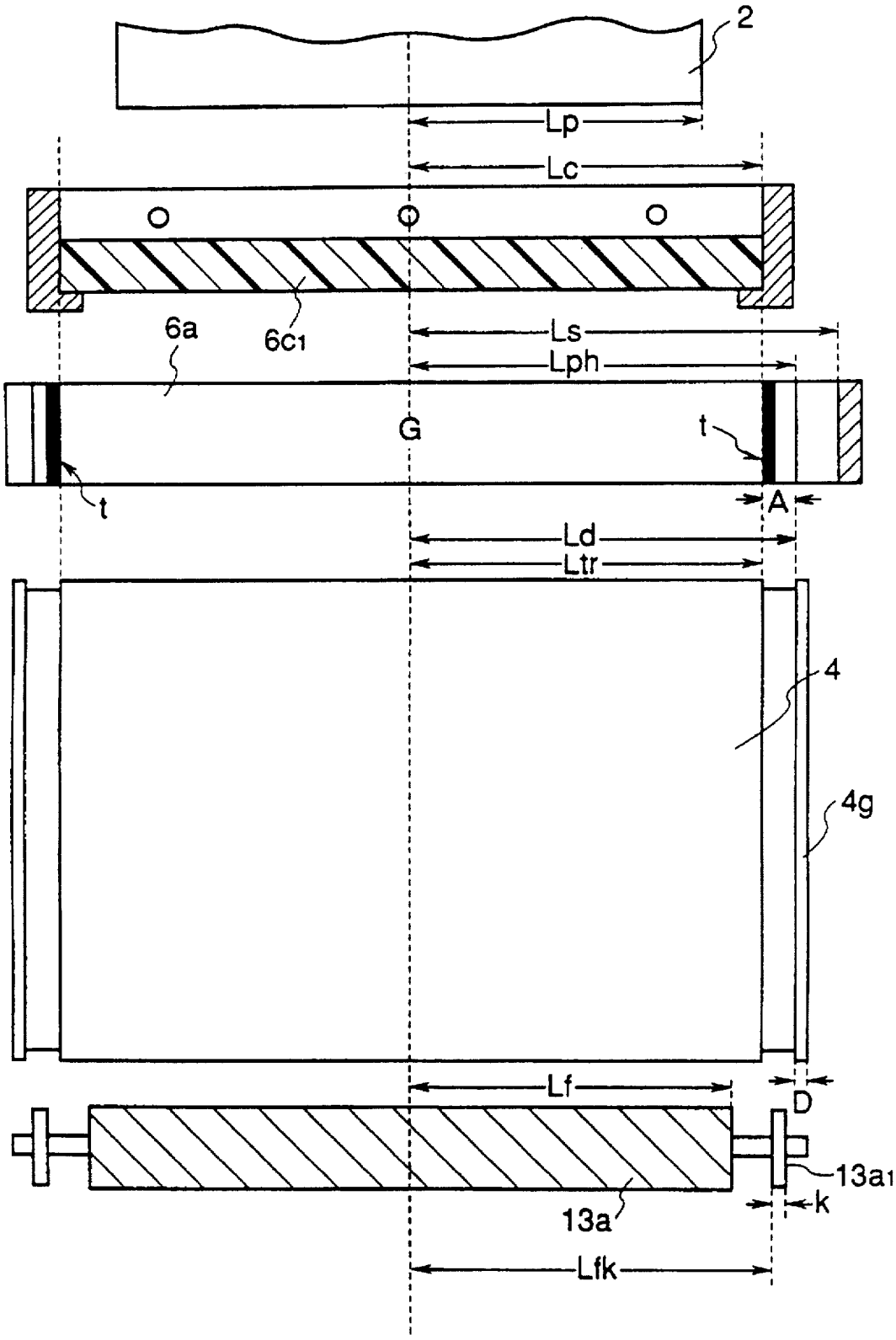
FIG. 6 is a schematic view showing a third embodiment of the present invention and further showing an arrangement of a distance regulating member $13a_1$ for regulating a distance between a cleaning member 13*a* for cleaning a transfer drum 4 and the transfer drum 4, as well as the longitudinal dimensional relation of FIG. 5.
Figure 7:
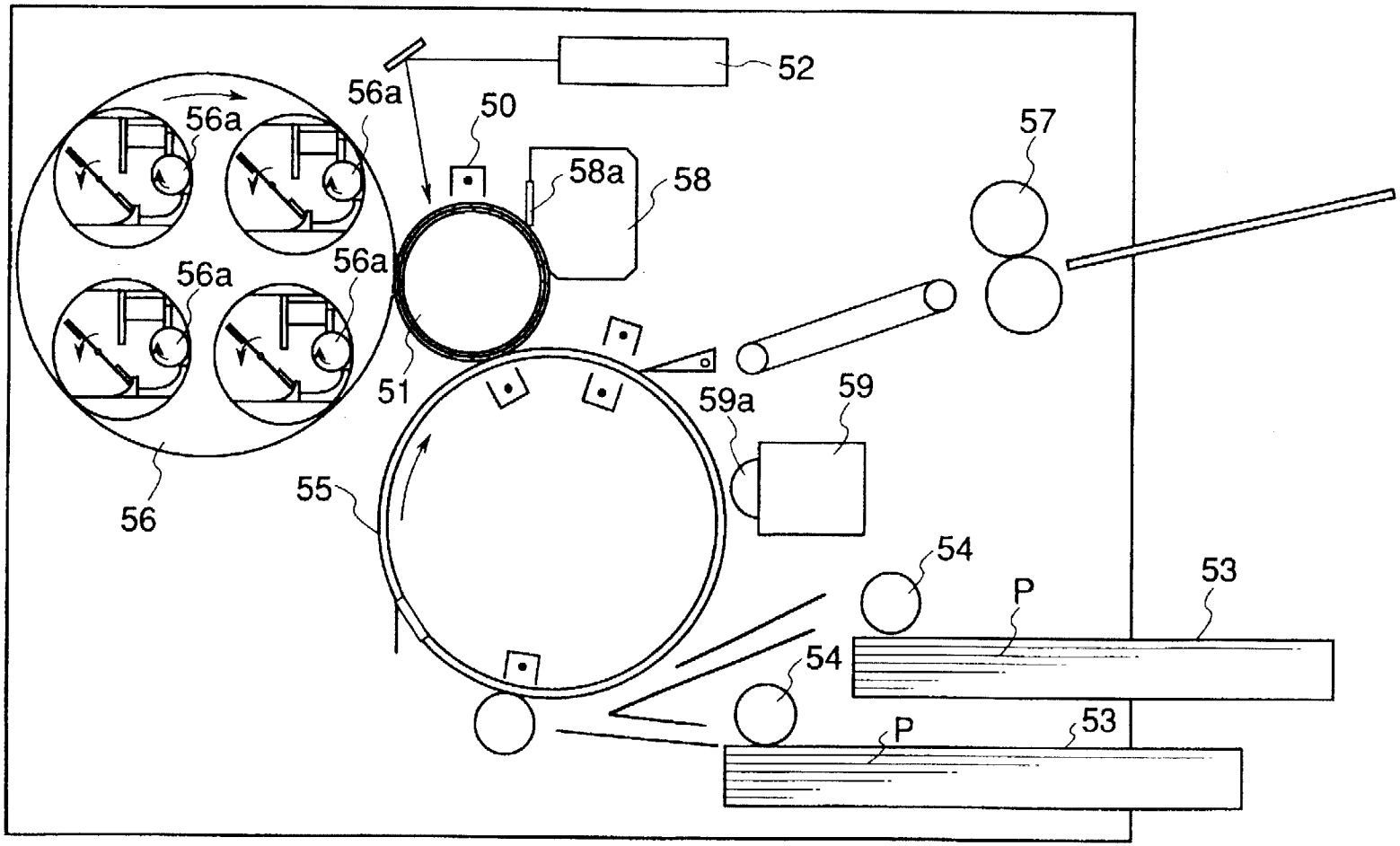
FIG. 7 is a sectional view of a conventional image forming apparatus in which techniques relating to the present invention are used.
Figure 8:
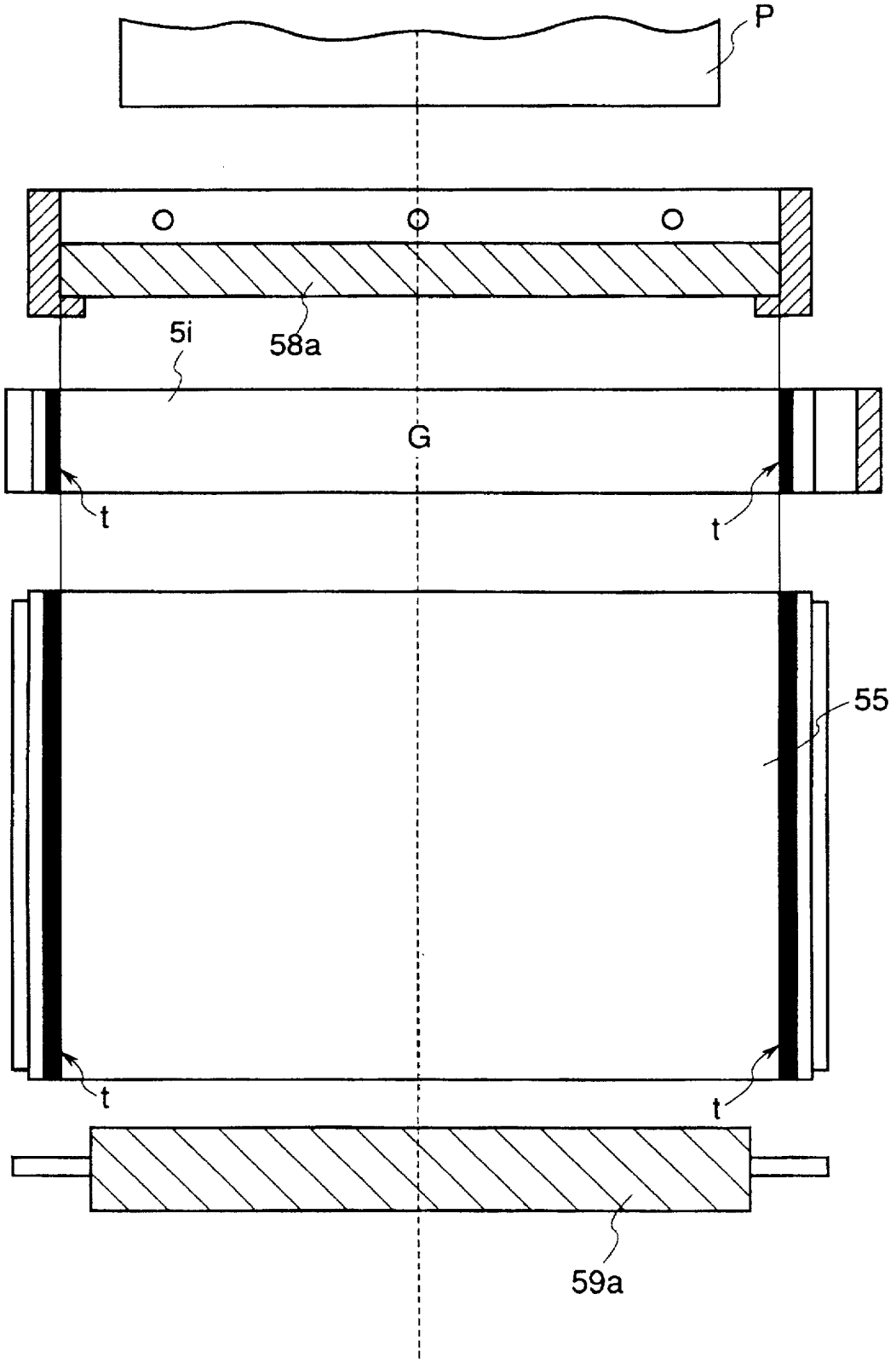
FIG. 8 is a schematic view showing a longitudinal dimensional relation between a photosensitive drum 51, a cleaning blade 58*a*, a transfer drum 55, a recording material P and a transfer drum cleaning member 59 in the apparatus of FIG. 7.

In this third embodiment, the construction of cleaning device 13 for a transfer drum 4 differs from that of the first embodiment. That is to say, as shown in FIG. 6, a supporting shaft of the fur brush 13a is provided at both ends with distance regulating members 13a1 for regulating a distance between the fur brush 13a and the transfer drum 4. The distance regulating members 13a1 abut against the stepped portions A formed on the ends of the transfer drum 4 and serve to regulate a distance between the recording material holding portion of the transfer drum 4 and the fur brush and also regulate a contact amount of the furs of the fur brush 13a abutted against the recording material holding portion. That is to say, when a distance between the reference line G and the inner surface of each distance regulating member 13a1 is Lfk, and a thickness of the distance regulating member 13a1 is k, the following relation is satisfied:

$$Ld>Lfk+k>Lfk>Ltr \quad (5)$$

With this arrangement, the excessive contact between the fur brush 13a and the recording material holding portion of the transfer drum 4 can be prevented, thereby reducing loads acting on the fur brush 13a and the transfer drum 4 and effectively using the stepped portions A on the transfer drum 4 since the distance regulating members 13a1 do not contact with the toner bands t formed on the image bearing member 6a.

In the above-mentioned first to third embodiments, while a color image forming apparatus having four developing devices and adapted to form the color image was explained, the image forming apparatus according to the present invention is not limited to the color image forming apparatus. Rather the present invention can be applied to a mono-color image forming apparatus having a single developing device as well. Further, the present invention may be applied to image forming apparatuses wherein an image is formed by using a process cartridge integrally including an image bearing member, a charge means, a cleaning member and a developing means as a unit which can be removably mounted to the apparatus. Furthermore, the present invention may be applied to image forming apparatuses wherein an image bearing member of an image bearing member unit, a charge means, a cleaning member and a developing means are independently arranged.

Further, in the above-mentioned embodiments, while the laser beam printer was explained, it should be noted that the present invention can be applied to copying machines, facsimile systems and the like, as well as the laser beam printers. Furthermore, the developing means may be of conventional two-component magnet brush developing type, cascade developing type, touch-down developing type, cloud developing type or the like.

Further, in the above-mentioned embodiments, while the charge means of a so-called contact charging type was explained, the charge means may be of the type wherein U-shaped three walls formed from tungsten wires are enclosed by a metallic shield made of aluminium or the like and positive or negative ions generated by applying high voltage to the tungsten wires are transferred to an image bearing member to uniformly charge the surface of the image bearing member.

Incidentally, the charge means may be of blade (charge blade) type, pad type, block type, rod type, wire type or the like, as well as the roller type.

Further, the cleaning means for removing the residual toner remaining on the image bearing member may comprise a blade, a fur brush, a magnet brush or the like.

Further, in the above-mentioned embodiments, while the image forming apparatus wherein the recording material bearing member, i.e. the transfer drum is used as the rotary member contacted with the image bearing member was explained, the present invention may be applied to image forming apparatus using a so-called intermediate transfer member wherein a toner image is directly transferred from an image bearing member to a rotary member and the transferred toner image is then transferred onto a recording material. In this case, the intermediate transfer member corresponds to the aforementioned rotary member.

As mentioned above, according to the present invention, since the length of the longitudinal contact area between the image bearing member and the rotary member is smaller than the length of the cleaning member, the toner is prevented from fusing to the rotary member, thereby obtaining the good image.

The present invention is not limited to the above-mentioned embodiments, but, various alterations and modifications can be effected within the scope of the present invention.

What is claimed is:

1. An image forming apparatus comprising:

an image bearing member;

image forming means for forming a toner image on said image bearing member;

a rotary member contacted with a surface of said image bearing member;

transfer means for transferring the toner image from said image bearing member to said rotary member; and a cleaning member for removing residual toner from said image bearing member;

wherein a longitudinal width of a contact area between said image bearing member and said rotary member is smaller than a length of said cleaning member, and wherein said rotary member is a recording material bearing member having a cylindrical metal core having a surface dielectric layer for bearing a recording material thereon, and the toner image on said image bearing member is transferred to the recording material borne by said recording material bearing member by said transfer means.

2. An image forming apparatus according to claim 1, wherein said recording material bearing member further comprises an elastic layer positioned between said metal core and said surface dielectric layer.

3. An image forming apparatus according to claim 1, wherein said cleaning member is an elastic blade.

4. An image forming apparatus according to claim 1, wherein said image bearing member includes a photosensitive layer, and, when a length of said photosensitive layer is Lph', a length of said cleaning member is Lc' and a length of a recording material bearing portion of said recording material bearing member is Ltr', the following relation is established:

$$Lph' \geqq Lc' \geqq Ltr'.$$

5. An image forming apparatus according to claim 4, further comprising a second cleaning member for cleaning said recording material bearing member, and wherein, when length of said second cleaning member is Lf' and length of the recording material in a direction perpendicular to a recording material conveying direction is Lp', the following relation is established:

$$Lph' \geqq Lc' \geqq Ltr' \geqq Lf' \geqq Lp'.$$

6. An image forming apparatus according to claim 1, wherein said image bearing member comprises an electrophotographic photosensitive drum.

7. An image forming apparatus according to claim 1, wherein said image forming apparatus forms a color image using toners.

8. An image forming apparatus comprising:

an image bearing member;

image forming means for forming a toner image on said image bearing member;

a rotary member contacted with a surface of said image bearing member;

transfer means for transferring the toner image from said image bearing member to said rotary member;

a cleaning member for removing residual toner from said image bearing member; and a distance regulation member for causing said transfer means abutting a surface of said image bearing member at a position outside of a contact area between said image bearing member and said rotary member, wherein a longitudinal width of the contact area is smaller than a length of said cleaning member.

9. An image forming apparatus according to claim 8, further comprising a second cleaning member for cleaning a recording material bearing member, wherein the second cleaning member is a brush having a length smaller than the width of the contact area.

10. An image forming apparatus according to claim 8, wherein said distance regulation member is provided at an end of said second cleaning member.

11. An image forming apparatus according to claim 8, wherein said image forming apparatus forms a color image by toners.

12. An image forming apparatus comprising:

an electrophotographic photosensitive member;

image forming means having a charge device, an optical device and a developing device for forming a toner image on said electrophotographic photosensitive member;

a rotary transfer member to which a toner image of said electrophotographic photosensitive member is directly transferred, the toner image on said rotary transfer member being transferred to a recording sheet being conveyed while contacting therewith; and an elastic blade for removing residual toner from said electrophotographic photosensitive member, wherein a longitudinal width of a contact area between said electrophotographic photosensitive member and said rotary transfer member is smaller than a length of said elastic blade.

13. An image forming apparatus according to claim 12, further comprising a brush cleaning member for cleaning said rotary transfer member, a length of the brush cleaning member being smaller than the width of the contact area.

14. An image forming apparatus according to claim 12, further comprising a distance regulating portion located outside of the contact area of said rotary transfer member in contact with said electrophotographic photosensitive member.

15. An image forming apparatus according to claim 12, further comprising a distance regulating portion contacted with said rotary transfer member at the end of said elastic blade.

16. An image forming apparatus according to claim 12, wherein said elastic blade is in contact with a surface of a photosensitive layer of said electrophotographic photosensitive member.

17. An image forming apparatus according to claim 12, wherein a width of an abutting area of said elastic blade with said rotary transfer member is larger than a width of a maximum size recording sheet.

18. An image forming apparatus according to claim 12, wherein said image forming apparatus forms a color image using toners.

* * * * *

UNITED STATES PATENT AND TRADEMARK OFFICE

CERTIFICATE OF CORRECTION

PATENT NO. : 5,678,151

DATED : October 14, 1997

INVENTOR(S) : MIYASHIRO ET AL.

It is certified that error appears in the above-identified patent and that said Letters Patent is hereby corrected as shown below:

Column 2

Line 18, "decreased." should read --decreases.--.

Column 4

Line 15, "synchronous" should read --synchronism--.

Column 5

Line 16, "aluminium" should read --aluminum--;
Line 29, "me" should read --means--, and close up right margin (line 30 should be moved to end of line 29); and
Line 46, "screw 6$c_3$." should read --screw 6c3.--.

Column 6

Line 37, "negative" should read --a negative--; and
Line 56, "roler 8b" should read --roller 8b--.

UNITED STATES PATENT AND TRADEMARK OFFICE

CERTIFICATE OF CORRECTION

PATENT NO. : 5,678,151

DATED : October 14, 1997

INVENTOR(S) : MIYASHIRO ET AL.

It is certified that error appears in the above-identified patent and that said Letters Patent is hereby corrected as shown below:

Column 7

Line 45, "fused," should read --fused--.

Column 11

Line 6, "aluminium" should read --aluminum--; and
Line 35, "but," should read --and--.

Signed and Sealed this

Twenty-sixth Day of May, 1998

*Attest:*

Bruce Lehman

BRUCE LEHMAN

*Attesting Officer*

*Commissioner of Patents and Trademarks*